US005125344A

United States Patent [19]

Kline et al.

[11] Patent Number: 5,125,344

[45] Date of Patent: Jun. 30, 1992

[54] LIMITED RANGE TRAINING PROJECTILE

[76] Inventors: Roy W. Kline, RD #2, Box 312, Newton, N.J. 07860; Sung-Kwong Chung, 471 Herrick Dr., Dover, N.J. 07801

[21] Appl. No.: 752,247

[22] Filed: Aug. 28, 1991

[51] Int. Cl.[5] ..... F42B 10/48

[52] U.S. Cl. ..... 102/529; 102/703; 244/3.1; 244/3.3

[58] Field of Search ..... 102/395, 498, 502, 529, 102/703; 244/3.1, 3.24, 3.3

[56] References Cited

U.S. PATENT DOCUMENTS

| | | | |
|---|---|---|---|
| H. 768 | 4/1990 | Kline et al. | 102/529 |
| 2,494,026 | 1/1950 | Anderson | 244/3.3 |
| 4,362,107 | 12/1982 | Romer et al. | 102/529 |
| 4,653,405 | 3/1987 | Paine | 102/529 |
| 4,708,065 | 11/1987 | Schilling et al. | 102/529 |
| 4,905,602 | 3/1990 | Buckland | 102/529 |

FOREIGN PATENT DOCUMENTS

| | | | |
|---|---|---|---|
| 126173 | 11/1984 | European Pat. Off. | 102/529 |
| 2286364 | 4/1976 | France | 102/529 |
| 2091856 | 8/1982 | United Kingdom | 102/529 |

*Primary Examiner*—Harold J. Tudor

[57] ABSTRACT

A limited range training projectile utilizes a two strake and flare combination or two slots with flare combination design to ballistically match a service round to a predetermined range. The design permits statically stable flight at a selected limited range and includes instability at a predetermined range to greatly limit the total range.

2 Claims, 2 Drawing Sheets

LIMITED RANGE TRAINING PROJECTILE

GOVERNMENTAL INTEREST

The invention described herein may be manufactured, used and licensed by or for the government for Governmental purposes without the payment of any royalty thereon.

BACKGROUND OF THE INVENTION

Many military training facilities do not have sufficient real estate to accomodate the range of standard ammunition, yet they are required to provide army personnel with realistic training. Frequently, because of the range limitation training rounds are chosen which have a limited range. It is desirable to have the training ammunition ballistically match the standard ammunition to the maximum range of interest. It is also important to have the training round similar in appearance and relatively inexpensive to manufacture.

The problem with prior art training rounds was that they failed to ballistically match the service round, to provide realistic training, and were too expensive to manufacture. The desirable maximum range of a kinetic energy training round is 8,000 meters at 10 degrees quadrant elevation. The prior art training round used with a M724A1, a spin stabilized projectile which is fired from a 105 mm rifled barrel at a muzzle velocity of about 5050 ft/s. The maximum range at 10 degrees quadrant elevation is about 11,000 meters compared to the desired range of 8,000 meters. Because the M724A1 is a higher drag projectile than the standard fin stabilized projectile it has to be launched at a higher muzzle velocity so that the drag differential between the two projectiles could be compensated for. Consequently, the range of ballistic match was insufficient for realistic training.

Another type of prior art training projectile was the XM901, which is basically a flare stabilized projectile having holes along the flare section. The holes are designed to attain a choked flow phenomenon at a predetermined mach number and range. After choked flow is achieved, the drag of the projectile will increase and the range will be limited. The problem with this prior art design is that it is expensive to manufacture and not particularly efficient. The XM901 matches the service round to about 2,000 meters, but not the service round effective range of 3,000 meters.

SUMMARY OF THE INVENTION

The present invention relates to a limited range training projectile which can be used at any military training facility which does not have sufficient real estate to accomodate the range of standard ammunition, yet is required to provide realistic training including ballistic match.

An object of the present invention is to provide a limited range training projectile which can be designed to closely match a service round ballistic performance at less than maximum range of the service round.

Another object of the present invention is to provide a limited range training projectile which ballistically matches a service round launched from a rifled barrel gun.

Another object of the present invention is to provide a limited range training projectile to closely match the ballistic performance of a service round, wherein the training projectile will undergo a spin yaw resonance instability at or near a predetermined range.

Another object of the present invention is to provide an inexpensive limited range training projectile to closely match a service round's effective trajectory.

A further object of the present invention is to provide a limited range training projectile having a two slot with flare combination design which undergoes spin yaw resonance instability at or near a predetermined range.

For a better understanding of the present invention, together with other and further objects thereof, reference is made to the following descriptions taken in connection with the accompanying drawings.

DETAILED DESCRIPTION OF THE PREFERRED EMBODIMENTS

Figure 3:
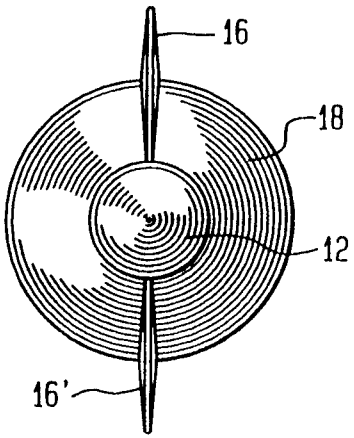
FIG. 3 is a right-hand side view of FIG. 1.
Figure 2:
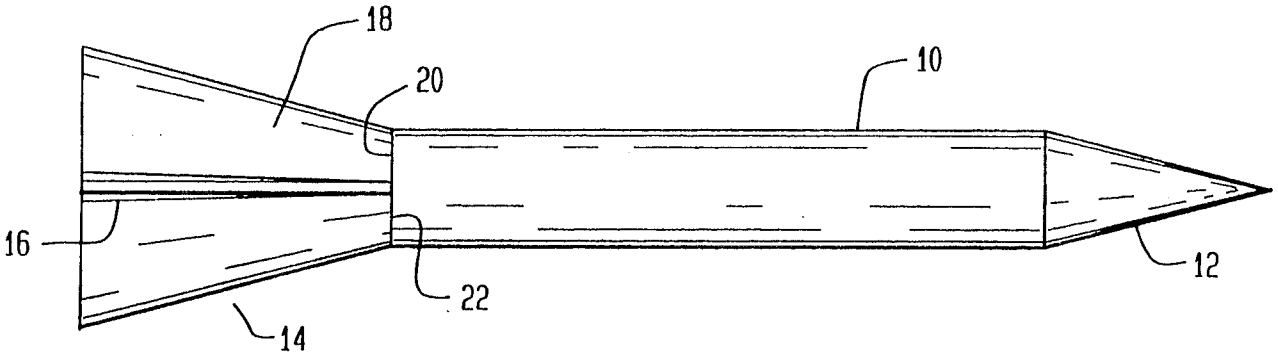
FIG. 2 is a top view of FIG. 1.
Figure 1:
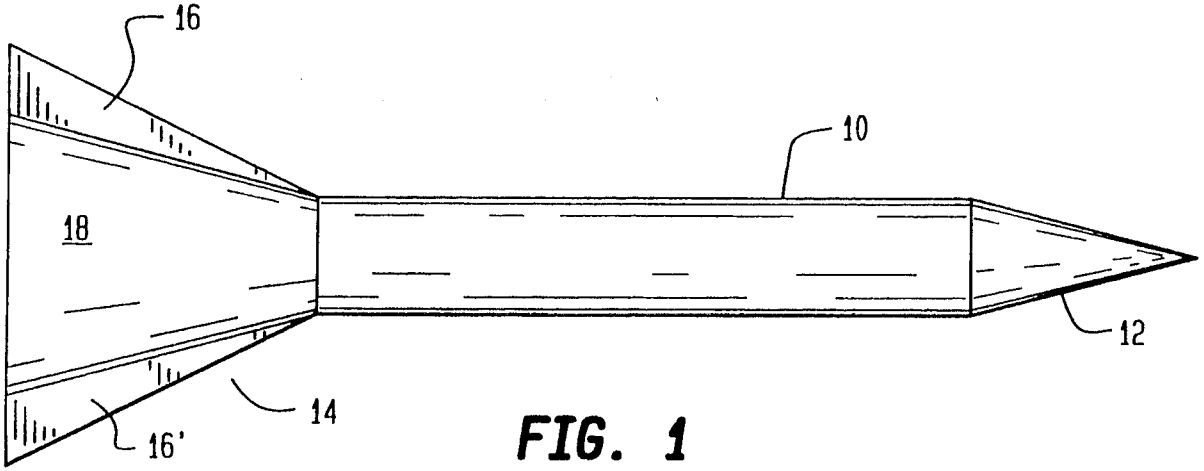
FIG. 1 is a plan view of a two-strake fin limited range projectile.

Referring now to FIGS. 1, 2 and 3 the projectile has a cylindrical body member 10 with a conically shaped front end 12 and a rear end assembly 14 which is comprised of two diametrically disposed fin members 16 and 16' (which are hereinafter reffered to as "strakes") which are fixedly attached to a (truncated) conically shaped flare member 18, (which geometrically is termed a "frustrum") having its forward narrow end 20 fixedly attached to the body member rear end 22.

Figure 6:
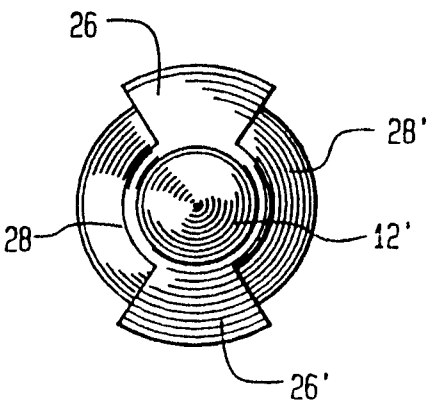
FIG. 6 is a right-hand side view of FIG. 4.
Figure 5:
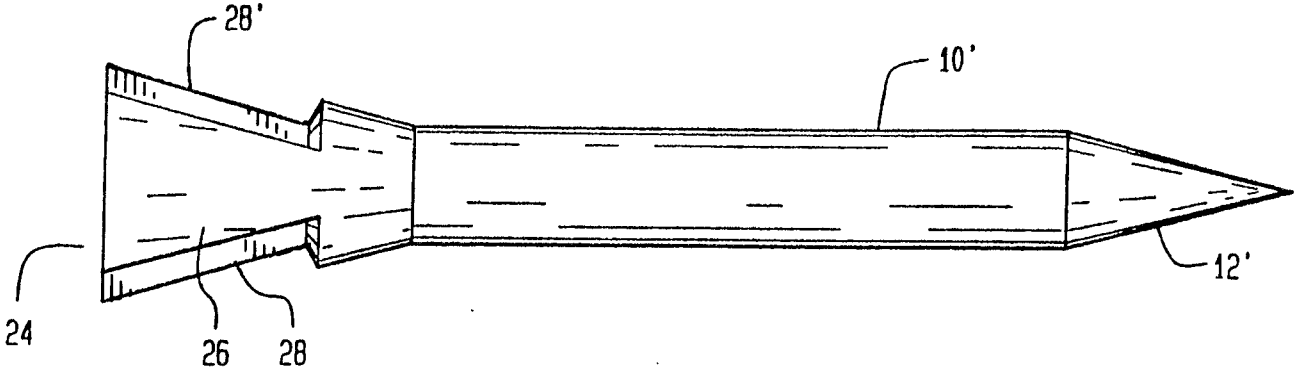
FIG. 5 is a top view of FIG. 4.
Figure 4:
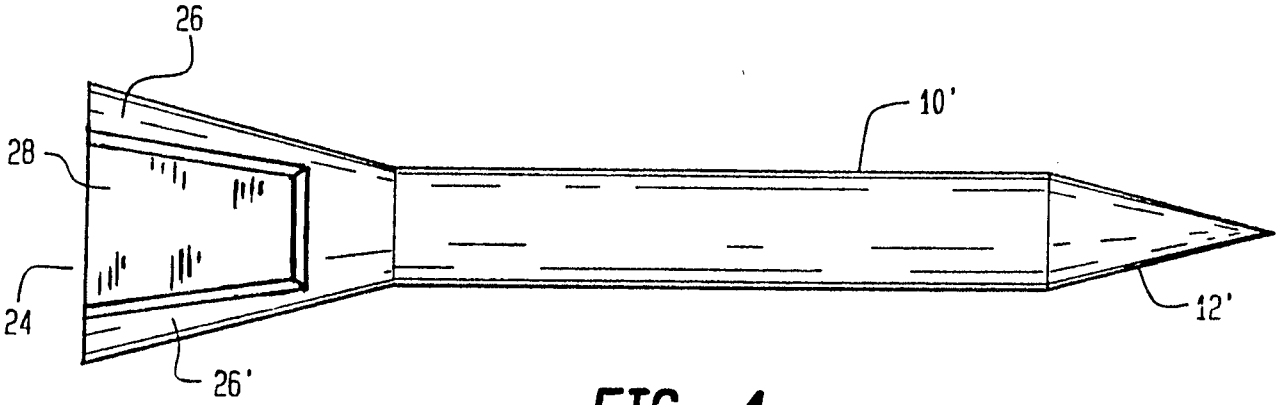
FIG. 4 is a plan view of a two-slot flare limited range projectile.

Referring now to FIGS. 4, 5 and 6 the projectile has a similar shaped cylindrical body member 10' and conically shaped front end 12' as shown in FIGS. 1, 2 and 3. A rear end assembly 24 comprises a (truncated) conically shaped flare segment member 26 and 26' having two diametrically opposed (truncated) conically shaped slots 28 and 28' (of different dimensions to 26 and 26') symetrically disposed therein. In operation the two-strake or two-slot flare limited range training projectiles shown in FIGS. 1–3 and 4–6 respectively are designed to closely match the standard round to 3,000 meters and has a maximum range that does not exceed 8,000 meters. These training rounds can be designed to match any projectile that is launched from a rifled barrel. The flares 18 and 28, 28' of the two strakes and two flare designs, respectively, contribute neutral stability to the projectile in the plane containing the strakes and static stability perpendicular to the plane containing the slots. The two strakes 16, 16' and the two flare segments 26, 26' provide planar stability. The (truncated) conically shaped flare portion 18 combined with the strakes 16, 16' provide static stability in the plane perpendicular to that containing the strakes for the design of FIGS. 1–3. At launch, at which time the projectile is subject to a high spin rate, the flares 18 and 26, 26' provide statically stable flight since the spin rate is higher than the yaw rate. As the projectile spin rate decays with the range, a coning motion will start to grow. Since at low spin rate, the strake or two-slot flare does not contribute to stability over increasing portion of the yaw cycle. The spin yaw resonance instability phenomenon will occur at a predetermined range causing the projectile to be subject to high drag and unstable flight. In this manner the projectiles of both designs, have maximum ranges which are greatly limited.

While a specific embodiment of the invention has been shown and described in detail to illustrate the application of the principles of the invention, it will be understood that the invention may be embodied otherwise without departing from such principles.

We claim:

1. A limited range training projectile which comprises:

a cylindrically shaped body member;

a conically shaped front end member operatively attached to said body member;

spin dampening and stabilizing means attached to the rear end of said body member for giving said projectile stability at high spin rate and for inducing spin yaw resonance instability at low spin rate, subjecting said projectile to high drag, unstable flight at a predetermined range, and limiting said projectile maximum range, said spin dampening and stabilizing means formed from a cone which is truncated to form a first cone-shaped frustrum having a circular base of a first base diameter and a circular top of a first top diameter, wherein the said first cone-shaped frustrum is thence cut to form notch-like slots therein such that, within the region of the slots only, the outer conical surface of said first cone-shaped frustrum thereafter follow the conical surface of a second coaxial cone-shaped frustrum, having a second base diameter which is less than said first base diameter, and a second top diameter which is substantially equal to said first top diameter, said slots extending over only a portion of the height of said first cone-shaped frustrum.

2. The projectile of claim 1 wherein said slots comprise two symmetrically opposite, equal-sized, essentially vertical cuts in the conical surface perimeter of said first cone-shaped frustrum.

* * * * *